United States Patent [19]

Gunn

[11] Patent Number: 4,718,887

[45] Date of Patent: Jan. 12, 1988

[54] CENTRIFUGAL SEPARATOR WITH A VERTICAL AXIS AND A SKIMMER

[75] Inventor: Michael L. A. Gunn, Milton Keynes, England

[73] Assignee: Westfalia Separator AG, Oelde, Fed. Rep. of Germany

[21] Appl. No.: 10,022

[22] Filed: Feb. 2, 1987

[30] Foreign Application Priority Data

Feb. 12, 1986 [DE] Fed. Rep. of Germany ..... 3604312

[51] Int. Cl.[4] ..... B04B 11/08

[52] U.S. Cl. ..... 494/58; 494/27

[58] Field of Search ..... 494/56, 57, 58, 59, 494/27, 29, 30, 3; 210/781, 782, 360.1

[56] References Cited

U.S. PATENT DOCUMENTS

| | | | |
|---|---|---|---|
| 2,261,394 | 11/1941 | Lindgren | 494/59 |
| 3,167,509 | 1/1965 | Steinacker | 494/3 |
| 3,468,475 | 9/1969 | Thylefors | 494/56 |

*Primary Examiner*—Robert W. Jenkins

*Attorney, Agent, or Firm*—Sprung Horn Kramer & Woods

[57] ABSTRACT

In a vertical centrifugal separator having a basket and a skimmer, laminar flow occurs at the bottom of an upper skimming disk and extends over the skimming-disk shaft into an annular catch chamber. Liquid-diversion channels leads from the catch chamber into an intake. Although the product is fed into the intake under higher-than-atmospheric pressure, the catch chamber, which is at atmospheric pressure, empties through the liquid-diversion channels because the high rate of flow in the intake produces an injector effect.

4 Claims, 1 Drawing Figure

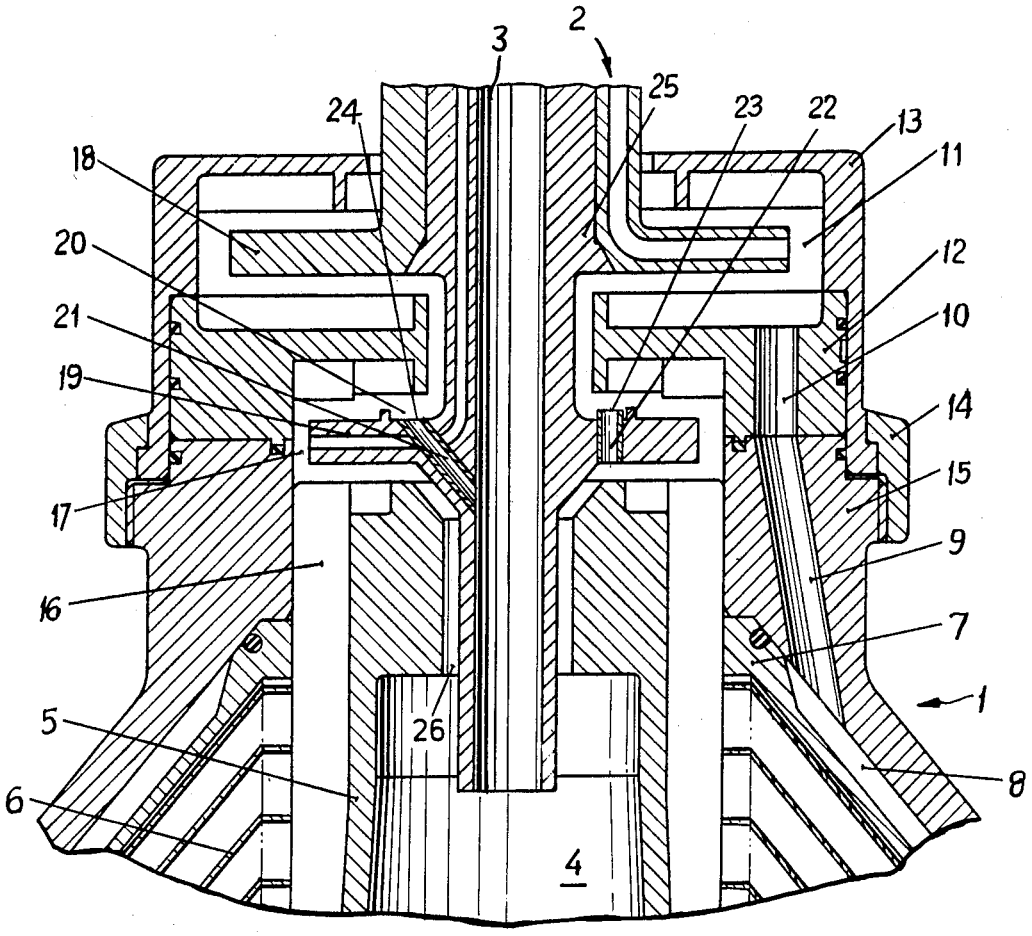
2
3
25
24
23
22
13
11
18
20
12
21
10
19
14
15
17
9
16
7
1
5
26
8
6
4

CENTRIFUGAL SEPARATOR WITH A VERTICAL AXIS AND A SKIMMER

BACKGROUND OF THE INVENTION

The present invention relates to a centrifugal separator with a vertical axis and a skimmer consisting of two skimming disks for separating mixtures of liquids, wherein one skimming disk diverts a specifically heavier fraction and the other diverts a specifically lighter fraction out of a basket, wherein the skimmer is located at a certain distance away from the rotating components of the basket and the skimming disks are located in skimming chambers, and wherein an annular catch chamber that is open toward the upper skimming disk, communicate with the skimmer, and has one or more liquid-diversion channels positioned between the upper skimming disk and the lower skimming disk.

A centrifugal separator of this type is known, for example from German Pat. No. 3 006 220. The purpose of the liquid-diversion channels is to keep the laminar flow of liquid that extends from the bottom of the upper skimming disk to the annular catch chamber away from the second skimming chamber. The liquid-diversion channels open into an annular channel that extends into the intake space of the basket. An annular channel of this type, which is concentric with the bottom connection of the stationary intake, makes it necessary to increase the diameter of the rotating opening that surrounds it— the intake opening into the basket's intake space. This diameter, however, must be kept as small as possible to maximize the output of liquid that can be put through it. The larger the diameter, the greater the risk of the intake space overflowing.

SUMMARY OF THE INVENTION

The object of the present invention is to improve a centrifugal separator of the aforesaid type to the extent that the diameter of the intake opening will not have to be increased.

This object is attained in accordance with the invention by the improvement wherein the liquid-diversion channels empty into the intake into the basket.

It has unexpectedly been discovered that, in spite of the pressure situation prevailing in the intake, no liquid will penetrate from the intake into the unpressurized annular channel through the liquid-diversion channels, whereas the liquid that arrives in the annular channel through the liquid-diversion channels will flow into the intake. This is due to the injector effect that occurs in the intake at high flow rates.

This injector effect on the liquid-diversion channels will be even greater if the liquid-diversion channels open downward into the intake at an acute angle.

To prevent excess pressure in the intake space that would keep liquid from flowing through the liquid-diversion channels, it may be necessary to provide a pressure-equalization channel in the lower skimming disk.

To prevent liquid from migrating from the top to the bottom of the lower skimming disk through the pressure-equalization channel, the pressure-equalization channels can terminate in the annular catch chamber and the intake into the pressure-equalization channels can be located above the floor of the catch chamber.

BRIEF DESCRIPTION OF THE DRAWINGS

A preferred embodiment of the invention will now be specified with reference to the attached drawing, in which the Figure is a cross sectional view of a portion of a centrifugal separator according to the invention.

DETAILED DESCRIPTION OF THE PREFERRED EMBODIMENTS

A skimmer 2 is secured to an unillustrated hood and positioned stationary in the basket 1 of a centrifugal separator at a distance from the rotating components of the basket. Skimmer 2 has a central intake 3 that supplies a mixture of liquids that is to be separated in the basket. The mixture is supplied to the intake space 4 of a distributor 5, and the liquid flows through a stack 6 of disks that rests on the distributor. The mixture is separated into specifically light and specifically heavy fractions at stack 6. The heavy fraction is flung into the outer vicinity of the basket and supplied above a dividing disk 7 to an upper skimming chamber 11 through channels 8, 9, and 10. Upper skimming chamber 11 is demarcated at the bottom by a floor 12 and at the top by a lid 13 that is secured to the lid 15 of basket 1 by a securing ring 14. The specifically light fraction flows through stack 6 toward the axis of the basket and is conveyed into a lower skimming chamber 17 through channels 16. The top of lower skimming chamber 17 is demarcated by the floor 12 of upper skimming chamber 11.

The upper skimming disk 18 of skimmer 2, which diverts the specifically heavy fraction, is accommodated in upper skimming chamber 11, and the lower skimming disk 19, which diverts the specifically light fraction is accommodated in lower skimming chamber 17. Above lower skimming disk 19 is an annular catch chamber 20, from which liquid-diversion channels 21 lead to intake 3. Pressure-equalization channels 22 lead from the bottom of lower skimming disk 19 into annular catch chamber 20. The intake 23 into pressure-equalization channels 22 extends beyond the floor 24 of catch chamber 20.

The liquid that wets the bottom of upper skimming disk 18 migrates to skimming-disk shaft 25 and thence into annular catch chamber 20, which empties into intake 3 through liquid-diversion channels 21. The intake opening 26 into the intake space 4 in distributor 5 can be kept small because only intake 3 extends through it.

It will be appreciated that the instant specification and claims are set forth by way of illustration and not limitation, and that various modifications and changes may be made without departing from the spirit and scope of the present invention.

What is claimed is:

1. In a centrifugal separator having a vertical axis, a basket and a skimmer above the basket for separating mixtures of liquid including a central intake for receiving liquid, an upper skimming disk in an upper skimming chamber, a lower skimming disk in a lower skimming chamber, and an annular catch chamber above the lower skimming disk and open towards the upper skimming disk, the improvement comprising liquid diversion channels providing liquid communication between the annular catch chamber and the intake.

2. The centrifugal separator as in claim 1, wherein the liquid-diversion channels open downward into the intake at an acute angle.

3. The centrifugal separator as in claim 1, further comprising a pressure-equalization channels in the lower skimming disk.

4. The centrifugal separator as in claim 3, wherein the pressure-equalization channels terminate in the annular catch chamber at a floor thereof and the intake into the pressure-equalization channels is located above the floor of the annular catch chamber.

* * * * *